US011111455B2

(12) United States Patent
Maruyama et al.

(10) Patent No.: US 11,111,455 B2
(45) Date of Patent: Sep. 7, 2021

(54) LUBRICATING OIL COMPOSITION FOR AUTOMATIC TRANSMISSIONS

(71) Applicant: SHELL OIL COMPANY, Houston, TX (US)

(72) Inventors: Ryuji Maruyama, Aikoh-Gun (JP); Genki Kamei, Aikoh-Gun (JP)

(73) Assignee: SHELL OIL COMPANY, Houston, TX (US)

( * ) Notice: Subject to any disclaimer, the term of this patent is extended or adjusted under 35 U.S.C. 154(b) by 5 days.

(21) Appl. No.: 16/331,212

(22) PCT Filed: Sep. 7, 2017

(86) PCT No.: PCT/EP2017/072518
§ 371 (c)(1),
(2) Date: Mar. 7, 2019

(87) PCT Pub. No.: WO2018/046623
PCT Pub. Date: Mar. 15, 2018

(65) Prior Publication Data

US 2019/0276764 A1 Sep. 12, 2019

(30) Foreign Application Priority Data

Sep. 9, 2016 (JP) ..... JP2016-176470

(51) Int. Cl.

| | |
|---|---|
| ***C10M 173/02*** | (2006.01) |
| ***C10M 135/22*** | (2006.01) |
| ***C10M 169/04*** | (2006.01) |
| ***C10M 101/00*** | (2006.01) |
| ***C10M 105/04*** | (2006.01) |
| ***C10M 107/02*** | (2006.01) |
| ***C10M 111/04*** | (2006.01) |
| ***C10M 145/14*** | (2006.01) |
| ***C10M 171/02*** | (2006.01) |
| *C10N 20/02* | (2006.01) |
| *C10N 20/04* | (2006.01) |

(Continued)

(52) U.S. Cl.

CPC ..... *C10M 169/041* (2013.01); *C10M 101/00* (2013.01); *C10M 105/04* (2013.01); *C10M 107/02* (2013.01); *C10M 111/04* (2013.01); *C10M 145/14* (2013.01); *C10M 171/02* (2013.01); *C10M 2203/003* (2013.01); *C10M 2203/1006* (2013.01); *C10M 2203/1025* (2013.01); *C10M 2205/0206* (2013.01); *C10M 2205/028* (2013.01); *C10M 2205/0225* (2013.01); *C10M 2205/0285* (2013.01); *C10M 2205/173* (2013.01); *C10M 2209/084* (2013.01); *C10N 2020/02* (2013.01); *C10N 2020/04* (2013.01); *C10N 2030/02* (2013.01); *C10N 2030/08* (2013.01); *C10N 2030/68* (2020.05); *C10N 2030/74* (2020.05); *C10N 2040/04* (2013.01); *C10N 2040/042* (2020.05); *C10N 2040/044* (2020.05); *C10N 2040/045* (2020.05); *C10N 2040/08* (2013.01); *C10N 2040/30* (2013.01); *C10N 2070/00* (2013.01)

(58) Field of Classification Search

CPC ..... C10M 169/041; C10M 145/14; C10M 107/02; C10M 105/32; C10M 2205/0206; C10M 2205/0225; C10M 2205/173; C10M 2209/084; C10M 2290/00; C10M 2207/2805; C10N 2030/74; C10N 2030/02; C10N 2030/68; C10N 2040/042

USPC ..... 508/507, 572

See application file for complete search history.

(56) References Cited

U.S. PATENT DOCUMENTS

| | | | |
|---|---|---|---|
| 6,332,974 | B1 | 12/2001 | Wittenbrink et al. |
| 8,227,392 | B2 | 7/2012 | Wu et al. |

(Continued)

FOREIGN PATENT DOCUMENTS

| | | | |
|---|---|---|---|
| JP | 2009096925 | A | 5/2009 |
| JP | 2011121991 | A | 6/2011 |

(Continued)

OTHER PUBLICATIONS

International Search Report and Written Opinion received for PCT Patent Application No. PCT/EP2017/072518, dated Nov. 9, 2017, 10 pages.

(Continued)

*Primary Examiner* — Prem C Singh
*Assistant Examiner* — Francis C Campanell
(74) *Attorney, Agent, or Firm* — Shell Oil Company

(57) ABSTRACT

The invention provides a lubricating oil composition for automatic transmissions is made such that it comprises proportionately as its main constituents: 60 to 98 mass % as low viscosity base oils being base oils belonging to Groups 2 to 4 of the API (American Petroleum Institute) base oil categories wherein the kinematic viscosity at 100° C. is 2 to 5 $mm^2/s$ (Fischer-Tropsch synthetic oil comprising at least 45 to 80 mass %); 1 to 20 mass % as high-viscosity base oils being metallocene/poly-α-olefins with a kinematic viscosity at 100° C. of 100 to 600 $mm^2/s$; and 1 to 20 mass % being a polymethacrylate with a weight-average molecular weight of 10,000 to 50,000. The viscosity index of this composition is not less than 190, the Brookfield viscosity at −40° C. is not more than 5000 mPa·s, the 100° C. kinematic viscosity is 5 to 7 $mm^2/s$, and the rate of reduction of the 100° C. kinematic viscosity after a KRL shear stability test (60° C., 20 hr) is not more than 3%.

6 Claims, No Drawings

(51) Int. Cl.

| | |
|---|---|
| *C10N 30/02* | (2006.01) |
| *C10N 30/08* | (2006.01) |
| *C10N 30/00* | (2006.01) |
| *C10N 40/04* | (2006.01) |
| *C10N 40/08* | (2006.01) |
| *C10N 40/30* | (2006.01) |
| *C10N 70/00* | (2006.01) |

(56) References Cited

U.S. PATENT DOCUMENTS

| | | | | |
|---|---|---|---|---|
| 10,227,544 | B2 | 3/2019 | Kim et al. | |
| 2005/0133407 | A1* | 6/2005 | Abernathy | C10M 177/00 208/18 |
| 2010/0087349 | A1* | 4/2010 | Lee | C10M 111/04 508/499 |
| 2011/0190183 | A1 | 8/2011 | Miyamoto et al. | |
| 2014/0011724 | A1 | 1/2014 | Onumata et al. | |
| 2016/0194578 | A1* | 7/2016 | Sakanoue | C10M 105/04 508/473 |

FOREIGN PATENT DOCUMENTS

| | | | |
|---|---|---|---|
| WO | 2014065984 | A1 | 5/2014 |
| WO | 2016050700 | A1 | 4/2016 |

OTHER PUBLICATIONS

Exxonmobil, "SpectraSyn EliteTM 300", Jan. 5, 2016, Retrieved from the Internet:URL:http://exxonmobilchemical.ides.com/en-US/ds133990/SpectraSyn Elite(TM)300.aspx?I=30156&U=0, XP055418625.

Kuo et al., "Automatic Transmission Oil and Its Maintenance", Car Repair and Maintenance, Oct. 31, 2008, 10 Pages.

* cited by examiner

LUBRICATING OIL COMPOSITION FOR AUTOMATIC TRANSMISSIONS

PRIORITY CLAIM

The present application is the National Stage (§ 371) of International Application No. PCT/EP2017/072518, filed Sep. 7, 2017, which claims priority from JP Application 2016-176470, filed Sep. 9, 2016 incorporated herein by reference.

FIELD OF THE INVENTION

This invention relates to a lubricating oil composition suitable for use in automatic transmissions.

BACKGROUND OF THE INVENTION

Lubricating oils, and in particular automatic transmission fluids, are used in automatic transmissions, including torque converters, wet clutches, gear bearing mechanisms and hydraulic mechanisms, but in order to actuate these automatic transmissions smoothly, it is a requirement to ensure that various functions such as the power transmission medium, lubrication of gears, heat transmission medium and maintenance of fixed friction characteristics are all kept in good balance.

In such automatic transmissions, it is necessary to modify the viscosity of the lubricating oil and to modify friction so as to ensure that shocks during gear changes are reduced as well as reducing energy losses while displaying good torque transmission functions.

To modify a lubricating oil as aforementioned, modifications to the viscosity of an overall composition can be made by using in the base oil a mineral oil of relatively low viscosity and using a polyacryl methacrylate therein as a viscosity index improver, see Japanese Laid-open Patent 2009-96925.

A lubricating oil composition for automatic transmissions is required to have low viscosity whereby churning resistance can be reduced, so that fuel consumption performance is improved. Also, lubrication performance must be capable of being maintained even in operating environments involving regions as cold as −40° C. and high-load/high-speed operation close to 200° C. For this reason, a low viscosity base oil has to be used, but problems such as evaporation and maintaining viscosity at high temperatures cause concern. The long-cherished desire has been to obtain a lubricating oil composition for automatic transmissions capable of withstanding such operating environments and in which the viscosity index at low viscosity is high, viscosity characteristics at low temperatures are excellent and shear stability is good, and also evaporation at high temperatures is low.

SUMMARY OF THE INVENTION

This invention provides a lubricating oil composition for automatic transmissions such that it comprises proportionately as its main constituents: 60 to 98 mass % as low viscosity base oils being base oils belonging to Groups 2 to 4 of the API (American Petroleum Institute) base oil categories wherein the kinematic viscosity at 100° C. is 2 to 5 $mm^2/s$, whereof Fischer-Tropsch synthetic oil comprises at least 45 to 80 mass %; 1 to 20 mass % as high-viscosity base oils being metallocene/poly-α-olefins with a kinematic viscosity at 100° C. of 100 to 600 $mm^2/s$; and 1 to 20 mass % being a polymethacrylate with a weight-average molecular weight of 10,000 to 50,000; and such that ranges are so maintained that the kinematic viscosity at 100° C. of the composition is 5 to 7 $mm^2/s$ and its viscosity index is not less than 190, the Brookfield viscosity at low temperature (−40° C.) is not more than 5000 mPa·s, the rate of reduction of the 100° C. kinematic viscosity after a KRL shear stability test (60° C., 20 hours) is not more than 3%, and the evaporation loss by the NOACK method for 200° C./1 hour is not more than 10 mass %.

DETAILED DESCRIPTION OF THE INVENTION

The lubricating oil composition of this invention has a high viscosity index at low viscosity, it excels as regards viscosity characteristics at low temperatures, and shear stability is good. Also, evaporation at high temperatures is low and it is possible to achieve a composition with outstandingly good oxidative stability while maintaining the friction characteristics. Even at times of high-temperature oxidation, changes in kinematic viscosity and viscosity index are within a small range of fluctuation, and the various functions such as the power transmission medium, lubrication of gears, heat transmission medium and maintenance of fixed friction characteristics are kept in good balance. It is therefore possible to use it for long periods always in the same state as a lubricating oil composition for automatic transmissions, and it is possible to make good use of it use it to improve fuel consumption.

This lubricant composition can also be used effectively over a wide range of industrial lubricating oils such as automobile gear oils, transmission fluids such AT fluids, MT fluids and CVT fluids, hydraulic fluids and compressor oils.

The base oils used as the aforementioned low viscosity base oils are those belonging to Groups 2 to 4 of the aforementioned API base oil categories, and the main constituent therein are GTL (gas-to-liquid) base oils synthesised by the Fischer-Tropsch process in the technology of making liquid fuels from natural gas. These GTL base oils themselves belong to Group 2 or Group 3 of the API base oil categories, but compared with mineral oil base oils refined from crude oil the sulphur and aromatics components are extremely low and the paraffin constituent ratio is extremely high, so that they have superior oxidative stability and very small evaporation losses, making them ideal for the base oil of this invention.

For these low viscosity base oils those with a kinematic viscosity at 100° C. of 2 to 5 $mm^2/s$ are to be used. The aforementioned GTLs also typically have tiny amounts for both total sulphur content, at below 1 ppm, and total nitrogen content, at below 1 ppm. One example of such a GTL base oil that may be mentioned is Shell XHVI (trade name).

The aforementioned low viscosity base oils can use a GTL alone or mixtures of a plurality of kinds with different kinematic viscosities at 100° C., and it is possible to use such GTLS together with base oils categorised as API Groups 2 to 4 such as mineral oils or poly-α-olefins.

A metallocene/poly-α-olefin is used for the aforementioned high viscosity base oil. This metallocene/poly-α-olefin is synthesised by using a metallocene catalyst when producing poly-α-olefins from α-olefins, and may be referred to below as a m-PAO.

A conventional PAO uses $AlCl_3$, $BF_3$, or Ziegler catalysts and the olefin is randomly polymerised with long and short side chains bonded to the main chain. But a m-PAO has a comparative periodicity and does not have short chains, having a structure close to a comb formation.

It is best to use for this m-PAO instances having a kinematic viscosity at 100° C. of 100 to 600 $mm^2/s$, and preferably 150 to 500 $mm^2/s$ and more preferably 300 to 500 $mm^2/s$.

If the aforementioned m-PAO has a kinematic viscosity at 100° C. of not less than 100 $mm^2/s$, this will be effective in improving the viscosity index of the lubricating oil composition obtained, whilst if it is not more than 600 $mm^2/s$, the effect will be to improve the shear stability of the lubricating oil composition obtained.

Known examples of a m-PAO as aforementioned include SpectraSyn Elite of the ExxonMobil Chemical company.

A polymethacrylate is blended in the lubricating oil composition of the invention. For this polymethacrylate (referred to below also as a PMA) it is best to use one with a weight-average molecular weight of the order to 10,000 to 50,000.

In addition, the weight-average molecular weight is preferably from 10,000 up to 40,000, but a weight-average molecular weight of from 10,000 up to 30,000 is more preferable, and a weight-average molecular weight of from 15,000 up to 30,000 is even more preferable.

If the weight-average molecular weight is smaller than 10,000, the viscosity index will reduce, and if it is greater than 50,000, problems such as a reduction in shear stability may occur.

The aforementioned low viscosity base oils belonging to the API base oil Groups 2 to 4, the m-PAO high viscosity base oil and the PMA viscosity index improver are used in such manner as to make the proportions, in that order, 60 to 98 mass %, 1 to 20 mass % and 1 to 20 mass %.

Further, in the 60 to 98 mass % which is low viscosity base oil as aforementioned, GTL base oil should comprise at least 45 to 80 mass % thereof.

If the aforementioned GTL base oil is less than 45 mass %, problems may arise in respect of properties such as low evaporation characteristics, low-temperature flow characteristics and shear stability, and the desired effect may not then be obtained.

If a m-PAO is used in the aforementioned proportion, it will be possible to improve the flow characteristics of the composition at low temperatures as well as maintaining a suitable viscosity at high temperatures. If this amount is less than 1 mass %, the effect on improvement of the viscosity index will tend to be unsatisfactory, and on the other hand if it exceeds 20 mass %, the viscosity at times of low temperatures will increase and there will be a risk that this will be detrimental to practical use. The preferred range is 1 to 15 mass %.

If the aforementioned viscosity index improver is less than the aforementioned 1 mass %, the high-temperature viscosity of the composition will decrease, and were it to be used for stepless gears there would be a risk that wear of mechanical parts would increase. Also, if it exceeds 20 mass %, the viscosity of the lubricating oil composition will rise and were it to be used for stepless gears problems may occur with increased friction losses. The preferred range is 2 to 15 mass %.

The PMA of the aforementioned viscosity index improver may contain a diluent (such as a mineral oil), and in such cases the net amount of the PMA is typically an amount of the order of 30 to 75%.

The lubricating oil composition as aforementioned must be so made that the kinematic viscosity at 100° C. is 5 to 7 $mm^2/s$. If the viscosity is lower than this, it will be difficult to maintain a high-temperature oil film, whereas if the viscosity is higher than this, the result will be that the churning resistance will increase and this will impact on fuel economy. It is preferably 6.0 to 6.6 $mm^2/s$.

Also, the viscosity index must be not less than 190. If it is lower than this, the viscosity at low temperatures will increase and churning resistance will increase. There will be an increased possibility that it will be difficult to maintain an oil film at high temperatures and that wear will increase.

Further, the Brookfield viscosity at the low temperature of −40° C. must be not more than 5000 mPa·s. By virtue of this, rises in viscosity at times of low temperature will be inhibited. If it is higher than this, startability in cold regions will deteriorate.

In addition, in KRL shear stability tests measured under conditions of 60° C./20 hours (hr), the rate of reduction of the 100° C. kinematic viscosity after the test has to be not more than 3%. If the shear stability is poor, viscosity reductions in the composition become large and there will be an impact on maintaining an oil film at high temperatures.

Also, the reduction in mass (mass %) after thermal degradation in NOACK evaporation tests through heating for 1 hour at 200° C. is made to be not more than 10 mass %. In this way, it becomes possible to maintain stability at high temperatures.

Where necessary, apart from the aforementioned principal constituents, various additives known in the art may be blended singly or in combinations of several kinds with the lubricating oil for automatic transmissions of this invention, for example extreme pressure additives, dispersants, metallic detergents, friction modifiers, anti-oxidants, corrosion inhibitors, rust preventatives, demulsifiers, metal deactivators, pour point depressants, seal swelling agents, defoamers and colourants.

Normally, in this case, it is common to use commercially available additives packages for automatic transmissions. The amount of these additives packages used is typically of the order of 7 to 13 mass %.

EXAMPLES

The lubricating oil composition for automatic transmissions of this invention is explained in more detail below by means of examples of embodiment and comparative examples, but the invention is in no way limited by these.

The following materials were provided for the examples of embodiment and comparative examples.

(1) Base Oils

{A} Low-viscosity base oils

A-1: GTL (gas-to-liquid) base oil (characteristics: 40° C. kinematic viscosity 9.891 $mm^2/s$, 100° C. kinematic viscosity 2.705 $mm^2/s$)

A-2: GTL (gas-to-liquid) base oil (characteristics: 40° C. kinematic viscosity 18.34 $mm^2/s$, 100° C. kinematic viscosity 4.110 $mm^2/s$)

A-3: Mineral oil (characteristics: 40° C. kinematic viscosity 10.00 $mm^2/s$, 100° C. kinematic viscosity 2.692 $mm^2/s$) ("Ultra S-2" made by S-Oil and "Yubase 3" made by SK Lubricants mixed in the proportions 42:58)

A-4: PAO (poly-α-olefin) (characteristics: 40° C. kinematic viscosity 9.915 $mm^2/s$, 100° C. kinematic viscosity 2.697 $mm^2/s$) ("Durasyn 162" made by INEOS and "SpectraSyn4 PAO Fluid" made by ExxonMobil Chemical mixed in the proportions 45:55)

{B} High-viscosity base oils

B-1: Ethylene-α-olefin copolymer (characteristics: 100° C. kinematic viscosity 600 $mm^2/s$) ("Lucant H0600" made by Mitsui Chemicals)

B-2: PAO (poly-α-olefin) (characteristics: 40° C. kinematic viscosity 401.8 $mm^2/s$, 100° C. kinematic viscosity 40.50 $mm^2/s$) ("Durasyn 174" made by INEOS)

B-3: PAO (poly-α-olefin) (characteristics: 40° C. kinematic viscosity 1500 $mm^2/s$, 100° C. kinematic viscosity 150 $mm^2/s$) ("SpectraSyn Ultra 150" made by INEOS.

B-4: m-PAO-65 (metallocene/poly-α-olefin) (characteristics: 40° C. kinematic viscosity 614 $mm^2/s$, 100° C. kinematic viscosity 65 $mm^2/s$) ("SpectraSyn Elite 65" made by ExxonMobil Chemical)

B-5: m-PAO-150 (metallocene/poly-α-olefin) (characteristics: 40° C. kinematic viscosity 1649 $mm^2/s$, 100° C. kinematic viscosity 156 $mm^2/s$) ("SpectraSyn Elite 150" made by ExxonMobil Chemical)

B-6: m-PAO-300 (metallocene/poly-α-olefin) (characteristics: 40° C. kinematic viscosity 3358 $mm^2/s$, 100° C. kinematic viscosity 303 $mm^2/s$) ("SpectraSyn Elite 300" made by ExxonMobil Chemical)

(2) Additives

{C} Viscosity Index Improvers

C-1: Polymethacrylate (weight-average molecular weight 5,200), polymer concentration 100%

C-2: Solution of polymethacrylate (weight-average molecular weight 16,000) in mineral oil. After measuring using GPC, the ratio of the peak area of the polymer component and the peak area of the base oil was 69:31. The GPC measuring conditions were as given below.

C-3: Solution of polymethacrylate (weight-average molecular weight 28,000) in mineral oil. The ratio of the peak area of the polymer component and the peak area of the base oil in GPC in similar fashion was 67:33.

C-4: Solution of polymethacrylate (weight-average molecular weight 85,000) in mineral oil. The ratio of the peak area of the polymer component and the peak area of the base oil in GPC in similar fashion was 36:64.

{D} Commercial ATF additives package: performance package corresponding to Dexron 6, as used in automatic transmissions in cars (does not include viscosity index improver)

Measurements Using GPC

The mass-average molecular weight was calculated by using JIS K7252-1 "Plastics—Determination of average molecular mass and molecular mass distribution of polymers using size-exclusion chromatography, Part 1: General principles."

Apparatus used: Shodex GPC-101

Detector: differential refractometer detector (RI)

Columns: KF-G (Shodex)×1, KF-805L (Shodex)×2

Measuring temperature: 40° C.

Carrier solvent: THF

Carrier flow rate: 0.8 ml/min (ref 0.3 ml/min) Standard substances: Shodex Standard (polystyrene)

$Mp=2.0\times10^3$ $Mp=5.0\times10^3$ $Mp=1.01\times10^4$ $Mp=2.95\times10^4$ $Mp=9.60\times10^4$ $Mp=2.05\times10^5$ Calibration curves: three-dimensional Sample concentration: approx. 2 mass %

Amount of sample injected: 50 μL

The fraction which made a peak at about 17 minutes for the retention time was the polymer constituent and the fraction making a peak at about 22 minutes was the base oil component.

The following examples of embodiment and comparative examples were prepared.

Example 1 (Inventive)

The lubricating oil composition of Example of Embodiment 1 was obtained by adding 8.6 mass % of base oil (B-5) and 10.5 mass % of additive (C-2) and 9 mass % of additive (D) to 71.9 mass % of the aforementioned base oil (A-1) and mixing well.

Examples 2 to 6 (Inventive)

The lubricating oil compositions of Examples of Embodiment 2 to 6 were obtained by using the formulations shown in Table 1, otherwise in accordance with Example of Embodiment 1.

Comparative Examples 1 to 8

The lubricating oil compositions of Comparative Examples 1 to 8 were obtained by using the formulations shown in Tables 2 and 3, otherwise in accordance with Example of Embodiment 1.

Tests

The following tests were appropriately carried out in order to ascertain the characteristics and performance of the aforementioned examples of embodiment and comparative examples.

40° C. Kinematic Viscosity: KV40

The 40° C. kinematic viscosity ($mm^2/s$) was measured on the basis of JIS K2283.

Evaluation Criteria:

Not more than 30.0 $mm^2/s$ . . . Good (O)

Exceeding 30.0 $mm^2/s$ . . . Poor (X)

100° C. Kinematic Viscosity: KV100

The 100° C. kinematic viscosity ($mm^2/s$) was measured on the basis of JIS K2283.

Evaluation Criteria:

From 5.0 to not more than 7.0 $mm^2/s$ . . . Good (O)

Below 5.0 or above 7.0 $mm^2/s$ . . . Poor (X)

Viscosity Index: VI

Calculated on the basis of JIS K2283.

Evaluation Criteria:

190 and above . . . Good (O)

Below 190 . . . Poor (X)

−40° C. Brookfield Viscosity: −40° C.·BF Viscosity: BF-40

The −40° C. low temperature viscosity (mPa·s□□ was measured on the basis of ASTM D 2983.

Evaluation Criteria:

Not more than 5000 mPa·s . . . Good (O)

Exceeding 5000 mPa·s . . . Poor (X)

NOACK Volatility Test

The test was carried out in accordance with ASTM D5800. That is to say, the rate of reduction in mass (mass %) after thermal degradation through heating for 1 hour at 200° C. was measured.

Evaluation Criteria:

Not more than 10.0 mass % . . . Good (O)

Exceeding 10.0 mass % . . . Poor (X)

KRL Shear Stability Test

On the basis of CEC-L-45-A-99, treatment was carried out for 20 hours at 60° C., and the 100° C. kinematic viscosity after the treatment was measured. The reduction (%) in the viscosity after the treatment relative to before the treatment was obtained for the 100° C. kinematic viscosity.

Evaluation Criteria:

Reduction in 100° C. kinematic viscosity not more than 3.0% Good . . . (O)

Reduction in 100° C. kinematic viscosity exceeding 3.0% . . . Poor (X)

Results

Tables 1 to 3 show the results of the aforementioned tests. Blank columns in the results of the tests for comparative examples are due to skipping the rest of the tests once it became clear from part of the test results that suitability could not be acknowledged.

In Examples 1 and 2, good results were obtained in both cases for 40° C. kinematic viscosity, 100° C. kinematic viscosity, viscosity index, −40° C.·BF viscosity, NOACK volatility and KRL shear stability. In addition, Example 3 used a mixture of base oils A-1 and A-2 and the amount of base oil B-6 used was far less than in Example 2, but the amount of additive C-2 used was greater, yet good results similar to Examples of 1 and 2 were obtained in the aforementioned tests.

Example 4 increased the amount of B-6 used to around double in comparison with Example 2 and instead of additive C-2 C-3 was used in almost of the amount. In comparison with Example 2, even better results were obtained in the −40° C.·BF viscosity, NOACK volatility and KRL shear stability tests.

Example 5, in comparison with Example 4, used base oils A-1 and A-3 together, and Example 6 used base oils A-1 and A-4 together. The NOACK volatility was somewhat higher but almost the same results as for Example 4 were obtained.

In contrast, Comparative Example 1 used a decreased amount of base oil B-1 in place of the base oils B-5 and 6 of Examples 1 and 2, and good results were obtained in both cases for 40° C. kinematic viscosity, 100° C. kinematic viscosity, viscosity index, NOACK volatility and KRL shear stability, but the value for −40° C.·BF viscosity was undesirably high. Comparative Example 2 used base oil B-2 in a high amount and the viscosity index was low. Comparative Example 3 used base oil B-3 and the reduction rate for KRL shear stability was high, and in the case of using base oil B-4 in Comparative Example 4, the viscosity index was low, so that in both cases desirable results were not obtained.

In Comparative Example 5 base oil A-3 and base oil B-6 were used and the −40° C.·BF viscosity and NOACK volatility were high, and in Comparative Example 6 base oil A-4 and base oil B-6 were used and the NOACK volatility was high, so that satisfactory results were not achieved. Comparative Examples 7 and 8 used base oil A-1 and base oil B-6 in a somewhat similar way as Example 4, but in the case of Comparative Example 7 the viscosity index was lower through using additive C-1, and Comparative Example 8 had poor results in the KRL shear stability test since it used additive C-4, and so it was evident that in neither case had satisfactory results been obtained.

TABLE 1

| | 1 | 2 | 3 | 4 | 5 | 6 |
|---|---|---|---|---|---|---|
| Base oil | | | | | | |
| A-1 | 71.9 | 73.9 | 53.0 | 74.7 | 49.8 | 49.7 |
| A-2 | | | 24.0 | | | |
| A-3 | | | | | 25 | |
| A-4 | | | | | | 25 |
| Base oil | | | | | | |
| B-1 | | | | | | |
| B-2 | | | | | | |
| B-3 | | | | | | |
| B-4 | | | | | | |
| B-5 | 8.6 | | | | | |
| B-6 | | 6.6 | 1.0 | 13.8 | 13.2 | 13.8 |
| Additive | | | | | | |
| C-1 | | | | | | |
| C-2 | 10.5 | 10.5 | 13 | | | |
| C-3 | | | | 2.5 | 3 | 2.5 |
| C-4 | | | | | | |
| Additive | | | | | | |
| D | 9 | 9 | 9 | 9 | 9 | 9 |
| Test results | | | | | | |
| VI | 193 | 196 | 190 | 191 | 191 | 191 |
| KV40 | 28.57 | 25.25 | 28.9 | 28.48 | 28.71 | 28.79 |
| KV100 | 6.505 | 6.509 | 6.516 | 6.459 | 6.49 | 6.502 |
| −40° C. BF viscosity | 5000 | 4900 | 5000 | 4400 | 4800 | 4300 |
| NOACK volatility | 8.4 | 8.4 | 8.1 | 6.8 | 9.1 | 9.3 |
| KRL shear stability | 2.1 | 2.5 | 2.8 | 1.4 | 1.7 | 1.5 |

TABLE 2

| | Comp. 1 | Comp. 2 | Comp. 3 | Comp. 4 |
|---|---|---|---|---|
| Base oil | | | | |
| A-1 | 76.3 | 68.1 | 72.5 | 68.9 |
| A-2 | | | | |
| A-3 | | | | |
| A-4 | | | | |
| B-1 | 4.2 | | | |

TABLE 2-continued

| | Comp. 1 | Comp. 2 | Comp. 3 | Comp. 4 |
|---|---|---|---|---|
| B-2 | | 12.4 | | |
| B-3 | | | 8 | |
| B-4 | | | | 11.6 |
| B-5 | | | | |
| B-6 | | | | |
| | | Additive | | |
| C-1 | | | | |
| C-2 | 10.5 | 10.5 | 10.5 | 10.5 |
| C-3 | | | | |
| C-4 | | | | |
| D | 9 | 9 | 9 | 9 |
| | | Test results | | |
| VI | 195 | 185 | 197 | 189 |
| KV40 | 28.42 | 29.48 | 28.31 | 29.2 |
| KV100 | 6.514 | 6.524 | 6.523 | 6.542 |
| −40° C. BF viscosity | 5300 | | | |
| NOACK volatility | 8.5 | | | |
| KRL shear stability | 2.6 | | 3.4 | |

TABLE 3

| | Comp. 5 | Comp. 6 | Comp. 7 | Comp. 8 |
|---|---|---|---|---|
| | | Base oil | | |
| A-1 | | | 73.6 | 79.7 |
| A-2 | | | | |
| A-3 | 75.1 | | | |
| A-4 | | 74.5 | | |
| B-1 | | | | |
| B-2 | | | | |
| B-3 | | | | |
| B-4 | | | | |
| B-5 | | | | |
| B-6 | 6.6 | 6.6 | 6.6 | 6.6 |
| | | Additive | | |
| C-1 | | | 10.8 | |
| C-2 | 9.3 | 9.9 | | |
| C-3 | | | | |
| C-4 | | | | 4.7 |
| D | 9 | 9 | 9 | 9 |
| | | Test results | | |
| VI | 191 | 193 | 186 | 224 |
| KV40 | 28.64 | 28.46 | 29.36 | 25.74 |
| KV100 | 6.491 | 6.488 | 6.51 | 6.493 |
| −40° C. BF viscosity | 5700 | | | |
| NOACK volatility | 14.5 | 16 | | |
| KRL shear stability | | | | 16.8 |

What is claimed is:

1. A lubricating oil composition for automatic transmissions, the lubricating oil composition comprising:

a low viscosity base oil at a concentration of 60% to 98% by mass, wherein the low viscosity base oil comprises one or more of a Group 2 base oil, a Group 3 base oil, and a Group 4 base oil, with each of the Group 2 base oil, the Group 3 base oil, and the Group 4 base oil being categories defined by the American Petroleum Institute, wherein the low viscosity base oil has a kinematic viscosity of 2 $mm^2/s$ to 5 $mm^2/s$ at 100° C., and wherein at least 45% by mass of the low viscosity base oil comprises at least one Fischer-Tropsch synthetic oil;

a high viscosity base oil at concentration of 1% to 20% by mass, wherein the high viscosity base oil comprises a metallocene/poly-α-olefin, and wherein the high viscosity base oil has a kinematic viscosity of a 100 $mm^2/s$ to 600 $mm^2/s$ at 100° C.; and a polymethacrylate at a concentration of 1% to 20% by mass, wherein the polymethacrylate has a molecular weight of 10,000 to 50,000 by weight-average, wherein the lubricating oil has:

a kinematic viscosity of 5 $mm^2/s$ to 7 $mm^2/s$ at 100° C.;

a viscosity index of at least 190;

a low temperature (−40° C.) Brookfield viscosity of not more than 5000 mPa·s;

a rate of reduction of not more than 3% as measured by a KRL shear stability test of a 100° C. kinematic viscosity; and an evaporation loss of not more than 10% by mass as measured by the NOACK method for 200° C./hour.

2. The lubricating oil of claim 1, wherein the low viscosity base oil further comprises 45% to 80% by mass of at least one Fischer-Tropsch synthetic oil.

3. The lubricating oil of claim 1, wherein the low viscosity base oil further comprises at least one of a mineral oil and a poly-α-olefin.

4. The lubricating oil of claim 1, wherein the metallocene/poly-α-olefin of the high viscosity base oil has a kinematic viscosity of a 300 $mm^2/s$ to 500 $mm^2/s$ at 100° C.

5. The lubricating oil of claim 1, wherein the polymethacrylate has a molecular weight of 15,000 to 30,000 by weight-average.

6. The lubricating oil of claim 1, wherein the low viscosity base oil further comprises 100% by mass of at least one Fischer-Tropsch synthetic oil.

* * * * *